US008757381B2

(12) United States Patent
Bouthiette

(10) Patent No.: US 8,757,381 B2
(45) Date of Patent: Jun. 24, 2014

(54) SEALING SHEET FOR USE TO CLOSE A CONTAINER-DEFINING SHEET

(71) Applicant: Chantel Hebert, Granby (CA)

(72) Inventor: Michel Bouthiette, Granby (CA)

(73) Assignee: 9155-0020 Quebec Inc., Quebec (CA)

( * ) Notice: Subject to any disclaimer, the term of this patent is extended or adjusted under 35 U.S.C. 154(b) by 0 days.

(21) Appl. No.: 13/721,664

(22) Filed: Dec. 20, 2012

(65) Prior Publication Data

US 2013/0284745 A1 Oct. 31, 2013

(30) Foreign Application Priority Data

Apr. 26, 2012 (CA) ..... 2776111

(51) Int. Cl.
*B65D 83/04* (2006.01)
*A61J 7/00* (2006.01)

(52) U.S. Cl.
CPC ..... *A61J 7/0069* (2013.01); *A61J 2205/30* (2013.01); *B65D 2575/3245* (2013.01); *B65D 2575/3281* (2013.01); *B65D 2575/366* (2013.01); *B65D 2583/0418* (2013.01)
USPC ..... 206/534; 206/538; 206/528; 206/532; 206/534.1; 206/530

(58) Field of Classification Search
CPC ..... A61J 2205/30; A61J 7/0084; B65D 2575/3245; B65D 2575/3281; B65D 2583/0418
USPC ..... 206/534, 538, 528, 530, 534.1, 539, 206/484, 484.2, 532
See application file for complete search history.

(56) References Cited

U.S. PATENT DOCUMENTS

| | | | | |
|---|---|---|---|---|
| 4,972,657 | A * | 11/1990 | McKee | 53/411 |
| 5,788,079 | A | 8/1998 | Bouthiette | |
| 6,382,420 | B1 * | 5/2002 | Bouthiette | 206/534 |
| 7,308,984 | B2 | 12/2007 | Bouthiette | |
| 7,543,709 | B2 * | 6/2009 | Bouthiette | 206/532 |
| 7,762,399 | B2 | 7/2010 | Bouthiette | |
| 7,802,683 | B2 * | 9/2010 | Bourque | 206/539 |
| 8,181,784 | B2 | 5/2012 | Bouthiette | |

* cited by examiner

*Primary Examiner* — Andrew Perreault
*Assistant Examiner* — James M Van Buskirk
(74) *Attorney, Agent, or Firm* — Fish & Richardson P.C.

(57) ABSTRACT

A sealing sheet for closing a container-defining sheet having a top surface comprising a given number of spaced apart cavities embossed therein, each of the cavities being upwardly opened and defining a container surrounded by a flange. The sealing sheet includes a top layer having a lower surface covered with pressure sensitive adhesive glue, and a bottom layer having an upper surface detachably fixed to the lower surface of the top layer by pressure sensitive adhesive glue. The bottom layer being peelable from the lower surface of the top layer to allow fixation of the sealing sheet onto the top surface of the container-defining sheet in order to close the containers defined in the same. The sealing sheet also includes an additional layer that is tearable into additional elements that are foldably attached on top of each of the containers and on which additional information may be printed.

13 Claims, 9 Drawing Sheets

SEALING SHEET FOR USE TO CLOSE A CONTAINER-DEFINING SHEET

CROSS-REFERENCE TO RELATED APPLICATION

The present invention claims the benefit of the priority of Canadian patent application No. 2.776.111 filed on Apr. 26, 2012.

BACKGROUND OF THE INVENTION

The present invention relates to an improvement to a sealing sheet used to close a plurality of containers formed in a container-defining sheet for the storage of pills.

BRIEF DESCRIPTION OF THE PRIOR ART

It is of common practice in the pharmaceutical field to prepare sets of individual containers containing pills and/or tablets to be administered to a patient. Each of these containers contains pills and/or tablets that the patient has to take together at the same time during the day over a given period of time (preferably one week).

To prepare such sets of individual pill containers for use by a patient, it is also of common practice to use a sheet of plastic material in which a plurality of cavities are embossed. Each of these cavities defines a small upwardly opened container that can be filled with pills. After filling, all the containers are closed by means of a sealing sheet on which all desirable indications can be printed, like the patient's name, the date and hour of administration, etc. As it can be understood, the indications are printed and formated onto the sealing sheet so that each group of information referring to a given container is positioned in regard to said container. Tearing lines are provided on both the container-defining sheet and the sealing sheet to permit easy separation of the individual pill containers.

For further information as to the structure, manufacture and use of such sets of individual pill containers, reference can be made to U.S. Pat. No. 5,788,079 and its Canadian counterpart no. 2,207,045 which both name the present inventor and are herein incorporated entirely by reference.

As disclosed in the above mentioned US and Canadian patents naming the present inventor, the sealing sheet used to close the containers can be made of paper or similar material and be glued onto the container-defining sheet. For this purpose, the sealing sheet comprises a top layer having a lower surface covered with a pressure sensitive adhesive glue and a bottom layer having an upper surface detachably fixed to the lower surface of the top layer by means of the adhesive glue. The bottom layer is peelable from the lower surface of the top layer to allow fixation of it onto the top surface of the container-defining sheet. Advantageously, this bottom layer has tearing lines punched into it in such a manner and position as to leave parts of it glued onto the bottom surface of the top layer in the form of a number of bottom pieces equal to the given number of cavities made in the container-defining sheet when the sealing sheet is peeled off. Each of these bottom pieces are shaped, sized and positioned so as to extend over a corresponding cavity of the container-defining sheet when the sealing sheet is properly applied to and glued on the flanges of the top surface of the container-defining sheet. These bottom pieces thus prevent the pill(s) stored in each of the containers from coming into contact with the adhesive glue.

As other examples of such a sealing sheet, reference can be made to Canadian patent no. 2,538,623 and U.S. Pat. Nos. 6,382,420, 7,543,709 and 7,762,399, all of which also name the present inventor and are also incorporated herein entirely by reference.

However, a problem that still remains in the sealing sheets presently in use and disclosed in the abovementioned patents, is that there is often not enough space onto the upper surface of the top layer of the container defining-sheet, to print all the information required regarding the content of each container.

SUMMARY OF THE INVENTION

The object of the present invention is to solve the above mentioned problem.

For this purpose, the present invention provides an improvement to a sealing sheet for use to close a container-defining sheet having a top surface comprising a given number of spaced apart cavities embossed therein, each of the cavities being upwardly opened and thus defining a container that is surrounded by a flange that is part of the top surface of the container-defining sheet.

Like the sealing sheets disclosed in the above mentioned Canadian and US patents, the sealing sheet according to the invention basically comprises:

- a top layer having an upper surface and a lower surface, said lower surface being covered with a pressure sensitive adhesive glue; and
- a bottom layer having an upper surface detachably fixed to the lower surface of the top layer by means of said pressure sensitive adhesive glue, said bottom layer being peelable from the lower surface of the top layer to allow fixation of the sealing sheet onto the top surface of the container-defining sheet in order to close the containers defined in the same.

The top layer has pairs of tearing lines punched therein. Each of said pairs of tearing lines is adjacent to one of the cover pieces extending from one side of said adjacent cover piece towards at least one adjacent corner of the bottom piece of the cover piece, in order to facilitate peeling of the bottom piece and of the corresponding part of the cover piece from the corresponding container and thus to give access to the element(s) stored in it.

The bottom layer also has tearing lines punched into it in such a manner and position as to leave parts of the bottom layer glued onto the bottom surface of the top layer in the form of a number of bottom pieces equal to the given number of cavities made in the container-defining sheet when said sealing sheet is peeled off. Each of said bottom pieces is shaped, sized and positioned so as to extend over a corresponding cavity of the container-defining sheet when the sealing sheet is properly applied to and glued on the flanges of the top surface of the container-defining sheet. Said bottom pieces thus prevent any element stored in the containers from coming into contact with the adhesive glue.

Advantageously, the container-defining sheet may comprise recesses embossed therein so as to extend adjacent to the one side of each of the cover pieces from which extend the tearing lines allowing peeling of the corresponding bottom piece from the corresponding container. These recesses are U-shaped so as to give easy access to a finger and thus facilitate such a peeling.

As it is disclosed in U.S. Pat. No. 7,543,709, the tearing lines of the bottom layer of the sealing sheet may also be devised so as to provide each of the bottom pieces with a small pulling tab projecting from one edge of the bottom piece, in such a manner that once the sealing sheet is glued on top of the container defining-sheet, the pulling tab extending at a short a distance away from the cavity of the corresponding container towards the adjacent recess embossed therein, such facilitating again peeling of the bottom piece from the container. The tearing lines of the bottom layer of the sealing sheet may also be devised so as to provide each of said bottom pieces with an extension opposite to the edge from which projects the pulling tab.

As aforesaid, the basic structure disclosed hereinabove of the sealing sheet according to the invention is known per se and disclosed in the above mentioned patents.

As a matter of fact, the present invention lies in an improvement to this basic structure of the sealing sheet.

This improvement essentially consists in an additional layer that may be glued onto the upper surface of the top layer in such a manner as to have one part foldably attached to the sealing piece of each individual pill container once such a pill container is separated. It is thus possible to print additional information as to the content of the corresponding pill container and its use, which can be read up, down or up and down of the part of the additional layer attached to the sealing piece, just by folding it.

So, the present invention is directed to a sealing sheet as disclosed herein above, which further comprises an additional layer having an upper part and a lower part attached to each other, said upper part having tearing lines punched into it in such a manner and position as to match with the tearing lines of the top layer of the sealing sheet and thus form an additional element on the upper surface of the top layer on each of said container, said lower part having peelable bands that can be removed to allow gluing of each of said additional elements onto the upper surface of the top layer of each container on one side of it so as to allow said additional elements to be folded up, said lower part also having tearing lines positioned to match those of the top part of the additional layer but except on the peelable bands, whereby, in use, additional information may be printed onto one or both sides of said additional layer to add information to what is located in each of the containers, such added information as well as the information already printed on the upper surface of the top layer being easily accessible by merely folding up the additional element of each of the container.

Preferably, the additional layer has opposite side borders that may be teared off in order to reduce the width of said additional layer and give easier access to the pulling tabs of the bottom pieces.

If needs be, the sealing sheet may also comprise another additional layer similar to the first one and attached in the same way to it and on which further additional information may be printed.

Of course, the sealing sheet including its additional layer, and the container-defining sheet are provided with positioning means to ensure proper positioning of both of them with respect to each other during installation and thus exact superimposition of the bottom pieces of the sealing sheet on top of the corresponding cavities, and exact superposition of the tearing lines of the top layer of the sealing sheet with the tearing lines of container-defining sheet.

The invention and its advantages will be better understood upon reading the following non restrictive description of a preferred embodiment of it, made with reference to the accompanying drawings.

DETAILED DESCRIPTION OF THE INVENTION

As indicated hereinabove, the present invention relates to an improvement made to a sealing sheet for use to seal a container-defining sheet like those especially devised to form sets of individual pill containers for use in pharmacies or hospitals.

Figure 1:
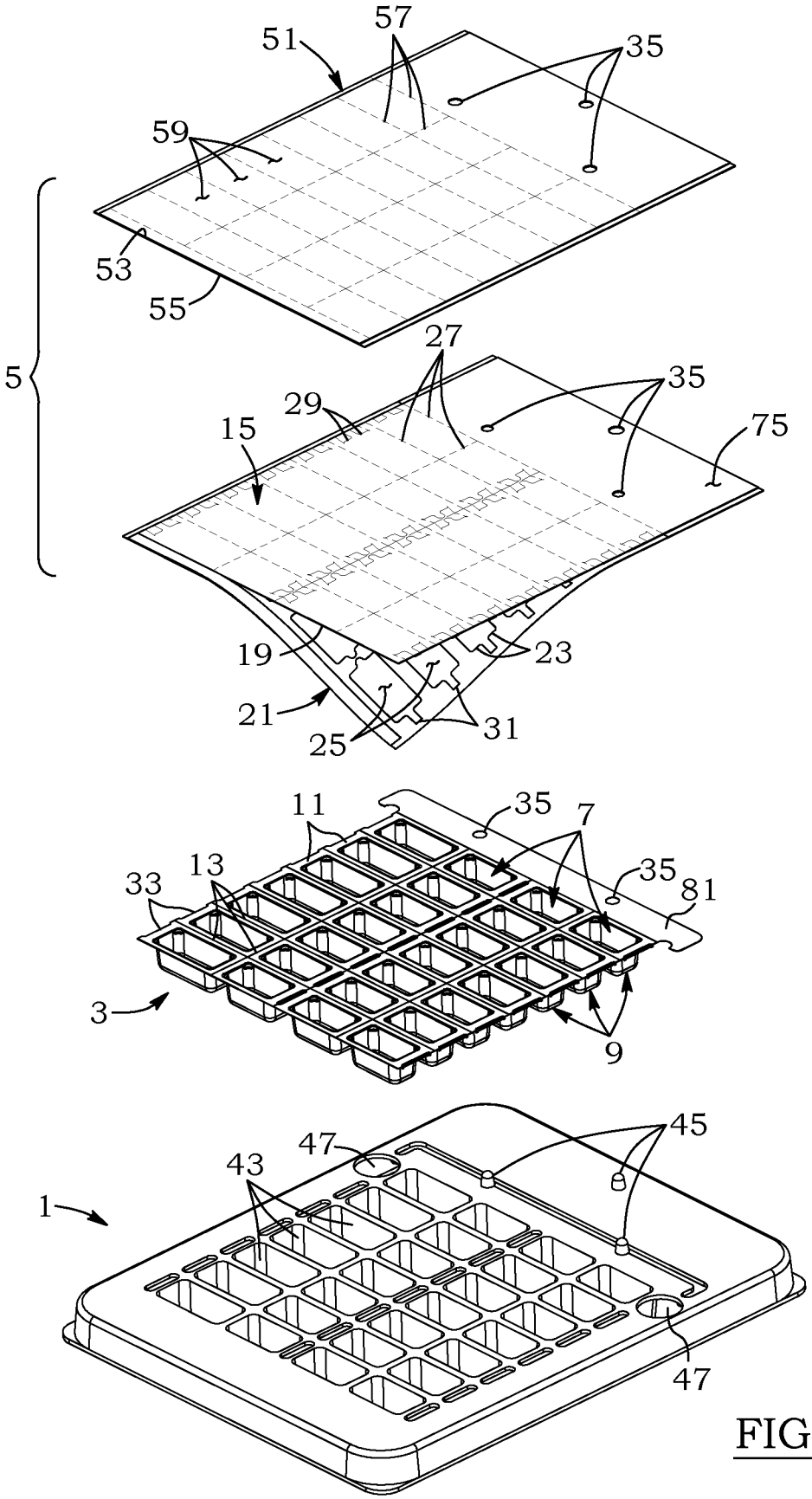
FIG. 1 is an exploded perspective view of a kit comprising a recessed support, a container-defining sheet and the bottom, top and additional layers of a sealing sheet of a set of individual pill container according to a preferred embodiment of the invention.

As aforesaid, FIG. 1 illustrates a kit comprising a recessed support 1, a container-defining sheet 3 and a sealing sheet 5 intended to be attached on top of the container-defining sheet 3, as disclosed in U.S. Pat. No. 7,543,709.

The container-defining sheet 3 is preferably made of a plastic material and has a top surface comprising a given number of spaced apart cavities 7 embossed therein. Each cavity 7 is upwardly opened and thus defines a container 9 which is surrounded by a flange 11. Each of the flanges 11 which is not directly adjacent to one external side of the container-defining sheet 3 is provided with a centrally positioned tearing line 13 so as to make it possible to detach each of the containers 9 from the other containers adjacent to it and thus from the container-defining sheet 3 whenever desired.

The purpose of the recessed support 1 mentioned hereinabove which is preferably made of rigid plastic material is to actually receive, hold and support one or more of said container-defining sheet 3. For this purpose, it comprises on its top surface, a plurality of recesses 43 that are equal in number to the number of containers 9 embossed on the container-defining sheet 3, and are positioned, shaped and sized to receive these containers 9. In the illustrated embodiment, the recessed support 1 also comprises a pair of holes 47 located on opposite sides of its top surface close to the side where are located upwardly pins 45. Such is particularly interesting in that such holes 47 allow the user to insert his/her fingers below the container-defining sheet and thus facilitate removal of the same.

The sealing sheet 5 is preferably made of paper and devised to be positioned on top of the top surface of the container-defining sheet 3 in order to close each of the containers.

As it is illustrated, the sealing sheet 5 comprises a top layer 15 which has a lower surface 19 that is covered with a pressure-sensitive adhesive glue. The sealing sheet 5 also comprises a bottom layer 21 that is detachably fixed to the lower surface 19 of the top layer 15 by means of the adhesive glue. The bottom layer 21 is devised to be peelable from the lower surface 19 of the top layer 15 in order to allow fixation of the sealing sheet 5 on to the top surface of the container-defining sheet 3 and thus close all the containers 9 on said sheet 3 made in this sheet 3.

As it is also shown in FIG. 1, the bottom layer 21 of the sealing sheets has tearing lines 23 that are punched into it in such a manner and position as to leave parts of the bottom layer 21 glued onto the bottom surface 19 of the top layer 15 in the form of a number of bottom pieces 25 equal to the number of cavities 7 made in the container-defining sheet 3 when the sealing sheet 5 is peeled off. Each of the bottom pieces 25 is shaped, sized and positioned so as to extend over a corresponding cavity 7 of the container-defining sheet 3 when the sealing sheet is properly applied to and glued on the flanges 11 located on the top surface of the container-defining sheet 3. As a result, these bottom pieces 25 prevent any element like pills stored in the containers 9, from coming into contact with the adhesive glue that was originally applied to all the adjacent surfaces of the top and bottom layers 15 and 21 of the sealing sheet 5. As to the particular position and protective effect of each of the bottom pieces 25, reference can be made to FIG. 9*c* of the drawings.

As it is illustrated, the tearing lines 23 of the bottom layer 21 of the sealing sheet 5 are advantageously devised to provide each of the bottom pieces 25 with a small pulling tab 31 projecting from one edge 26 of the bottom piece, hereinafter called "front edge", in such a manner that, once the sealing sheet 5 is glued on top of the container-defining sheet 3, this pulling tab 31 extends at a short distance away from the cavity 7 of the corresponding container 9 towards an adjacent recess 33 embossed therein. Such advantageously facilitates peeling of the bottom piece 25 from the container 9.

The recesses 33 are preferably U-shaped, so as to give easy access to a finger and thus facilitate such a peeling. Such substantially facilitates access to the content of each container 9.

Figure 9B:
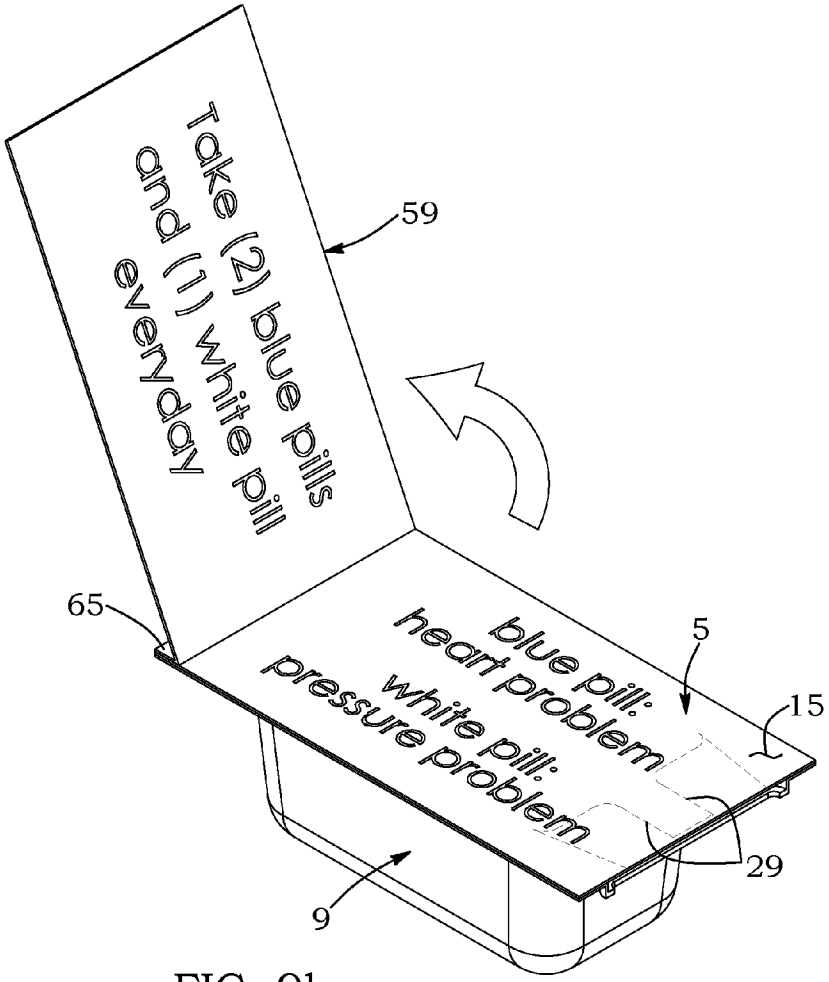
FIGS. 9*a*, 9*b* and 9*c* are perspective views of a container obtained after its separation, showing how the additional layer glued on it can be folded, and giving an example of information that can be provided onto it and on the upper surface of the top layer of the sealing sheet before the same is pulled.
Figure 9A:
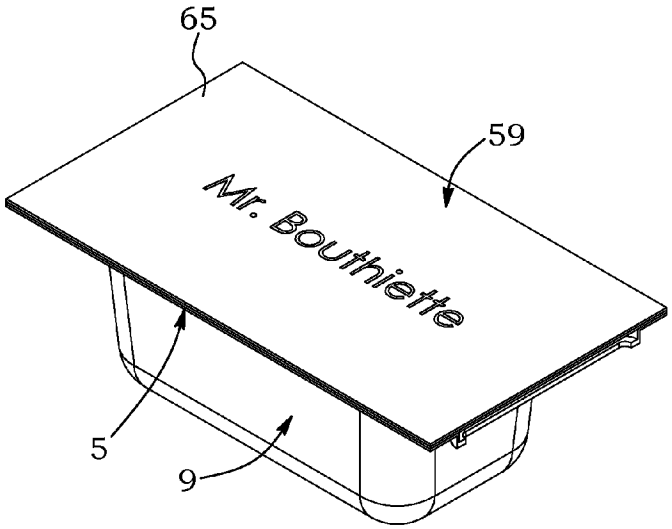
Figure 9D:
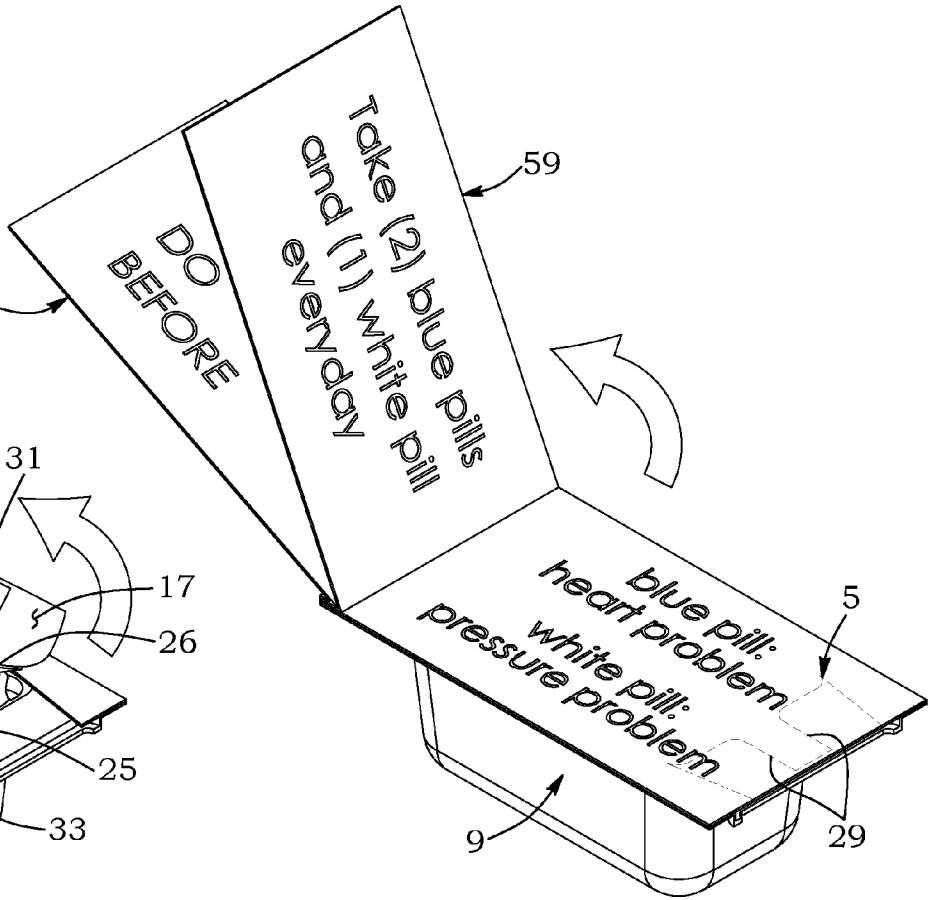
FIG. 9*d* is a perspective view similar to the one of FIG. 9*b*, but illustrating the container with two additional layers glued on it to increase the place where information may be printed.
Figure 9C:
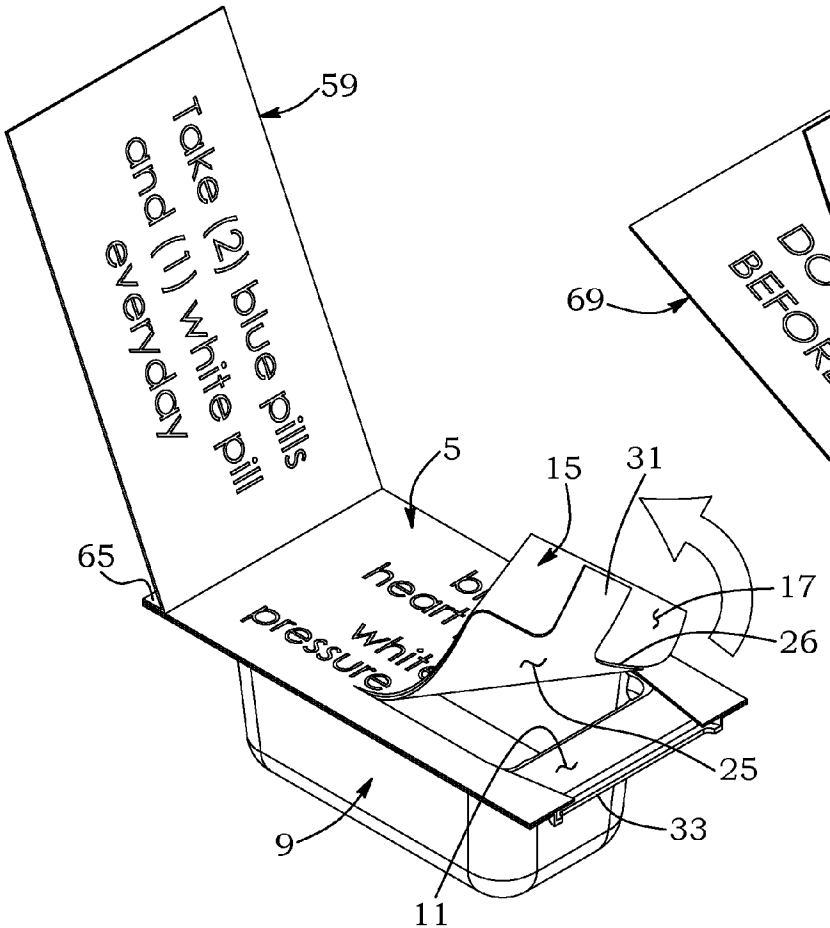

As it is also shown in FIGS. 1 and 9*c*, the top layer 15 of the sealing sheet 5 has tearing lines 27 punched therein in such a manner and position as to be in line with the tearing lines 13 of the container-defining sheet 3, in order to allow the top layer 15, once glued onto the flanges 11 on top of the container-defining sheet 3, to be splitted into a number of cover pieces 17 equal to the number of containers 9. Such is actually necessary to allow detachment of each of the containers 9 from the container-defining sheet 3 while keeping the so-detached containers closed.

The top layer 15 of the sealing sheet 5 also has pairs of tearing lines 29 punched therein, each of said pairs being adjacent to one of the cover pieces 17 extending from one side of the corresponding cover piece 17 towards one adjacent side of the corresponding bottom piece 25.

The purpose of these tearing lines 29 is to facilitate peeling of the bottom piece 25 and of the corresponding part of the cover piece 17 from the corresponding container and thus facilitate access to the elements stored therein.

For further information concerning the structure of the above sealing sheet, reference can be made inter alia to the above mentioned U.S. Pat. No. 7,543,709.

As aforesaid, the present invention lies in that the above mentioned sealing sheet 5 is improved in that it also comprises an additional layer 51 having an upper part 53 and a lower part 55 attached to each other. The upper part 53 has tearing lines 57 punched into it in such a manner and position as to match with the tearing lines 27 of the top layer 15 of the sealing sheet and thus form an additional element 59 on the upper surface of the top layer on each of the containers 9, as shown in FIGS. 9*a* to 9*d*. As shown also in FIGS. 2 and 3, the lower part 55 of the additional layer has peelable bands 61 that can be removed to allow gluing of each of the additional elements 59 onto the upper surface of the top layer 15 of each container 9 on one side of it so as to allow said additional element 59 to be folded up as shown in FIGS. 9*b* and 9*c*. Of course, for this purpose, the lower part of the additional layer 51 also has tearing lines 63 positioned to match those 57 of the top part of the additional layer, but not on the peelable bands.

In practice, the positioning of the peelable bands 61 has to be made in such a manner that the portion 65 of the additional element 59 glued onto one side of each container 9, be actually opposite to the side of said container 9 where are located the tearing lines 29 of the top layer 15 of the sealing sheet.

As shown again in FIGS. 9*a* to 9*c*, additional information may be printed onto one or both sides of the additional layer to add information to what is located in each of the containers, such added information as well as the information already printed on the upper surface of the top layer being easily accessible by merely folding up the additional element 59 of each of the container 9.

Figure 2:
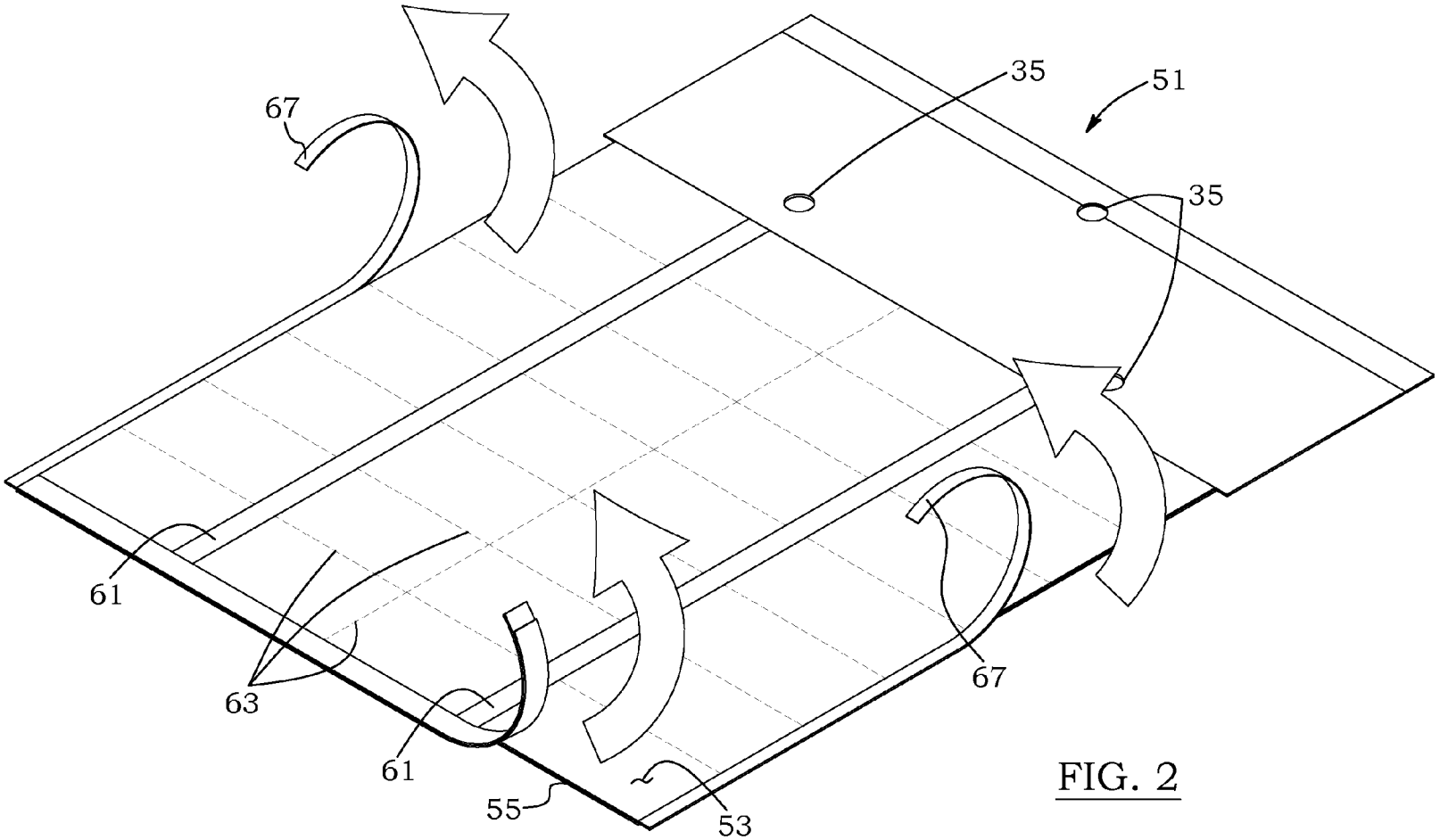
FIG. 2 is bottom perspective view of the additional layer of the sealing sheet shown in FIG. 1, illustrating however the border and bottom sides of it may be teared.
Figure 3:
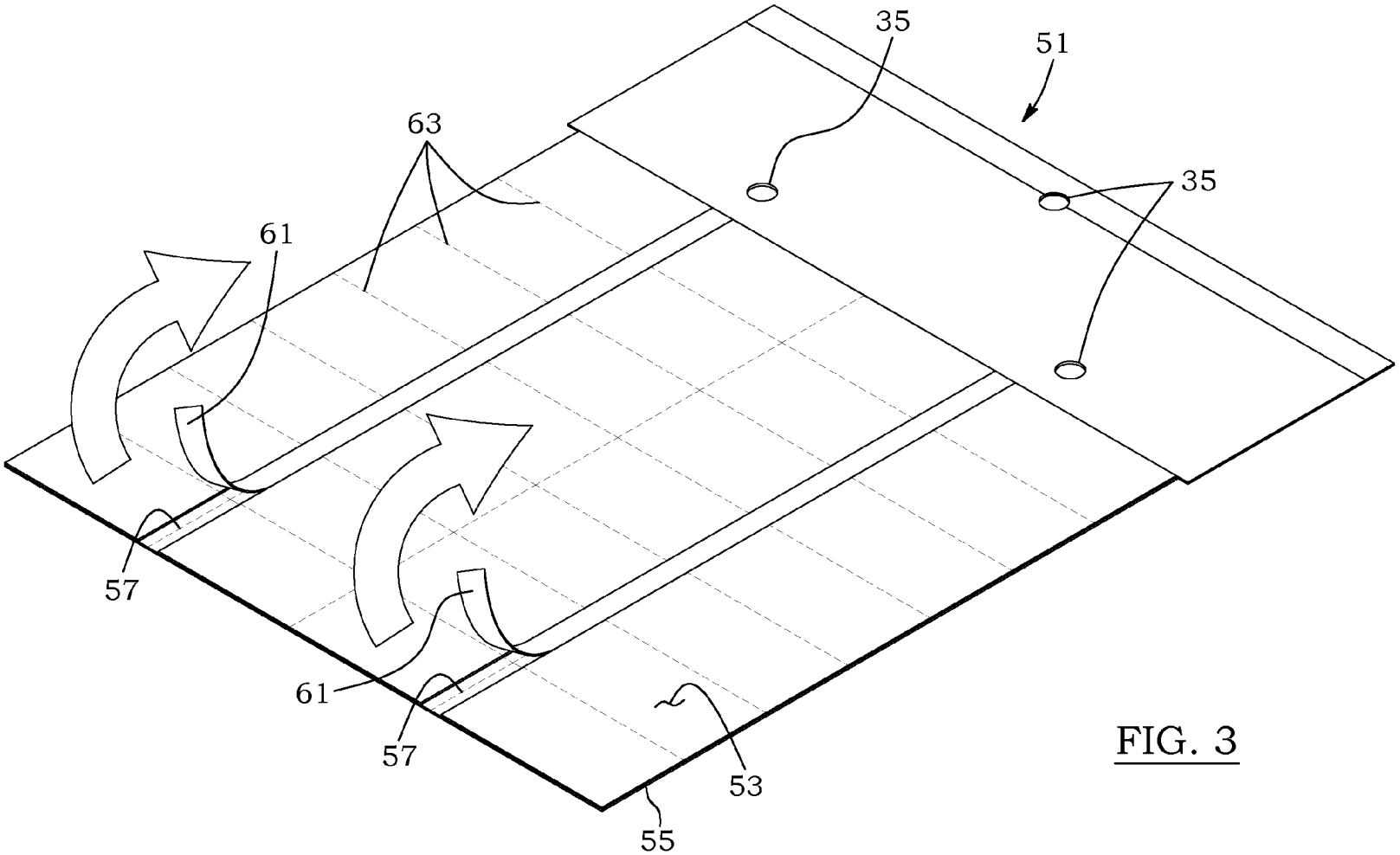
FIG. 3 is a bottom perspective of the additional layer shown in FIG. 2, illustrating the location of the pealable bands and how they can be removed to allow gluing of the same on the upper surface of the top layer of the sealing sheet.
Figure 4:
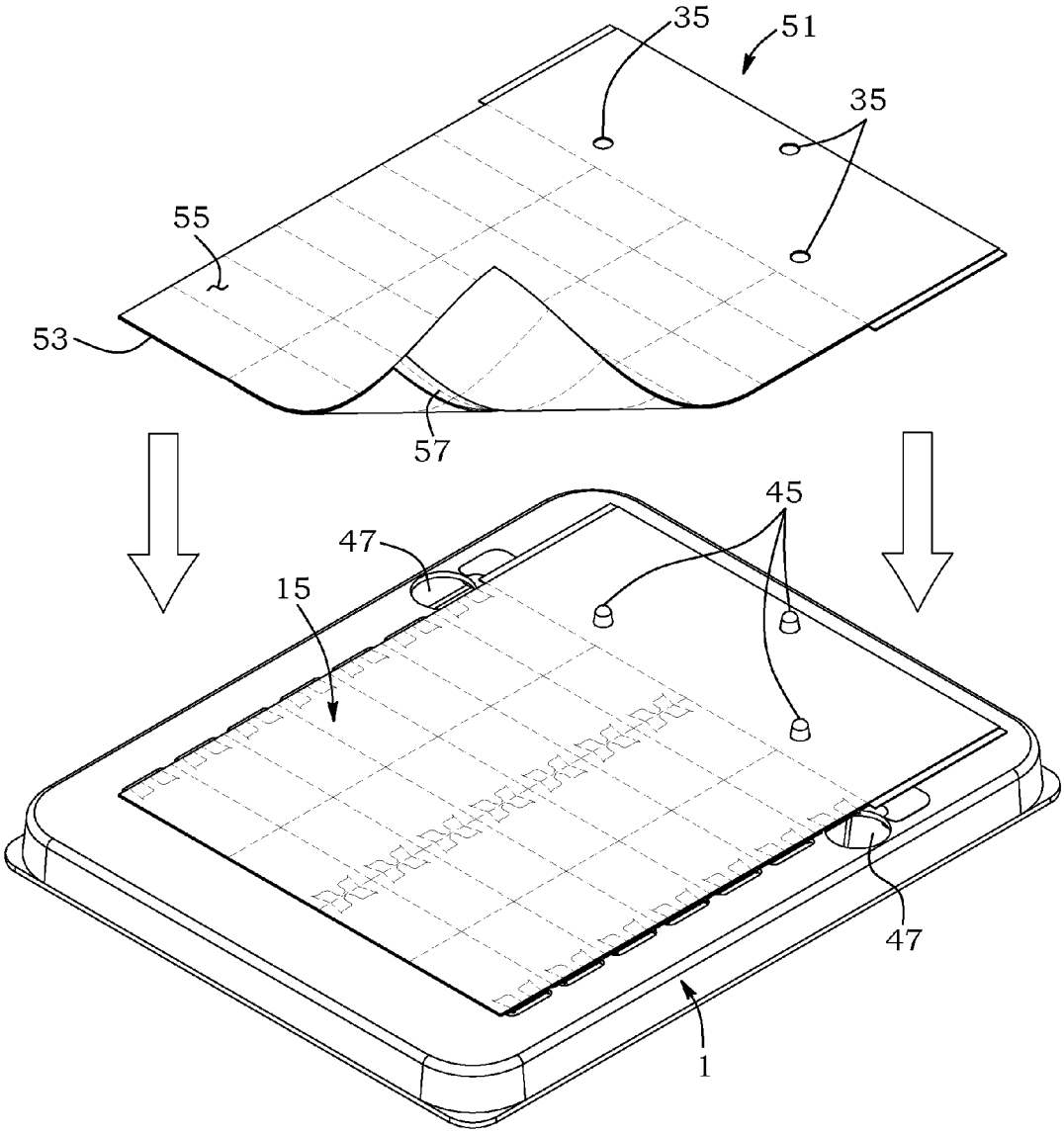
FIG. 4 is a perspective view illustrating how the additional layer can be applied for gluing onto the upper surface of the top layer.
Figure 5:
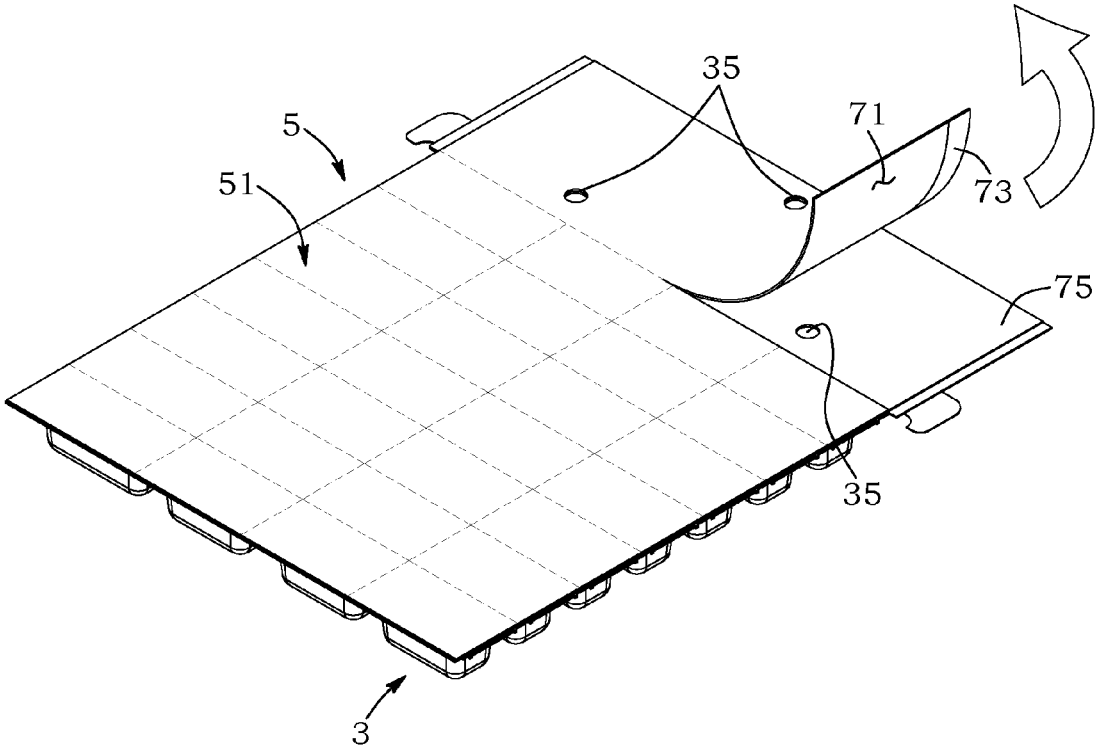
FIG. 5 is a perspective view of the container defining sheet after its closing with the sealing sheet and its removal from the recessed support used for their assembly, said figure also illustrating the tearing of the upper portion of the additional layer used for its positioning.
Figure 6:
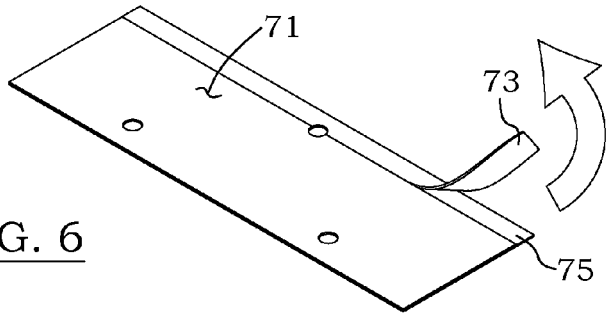
FIG. 6 is a perspective view of the upper portion of the additional layer after it has been teared and how a peelable band made on it can be removed to allow its gluing onto the upper portion of the sealing sheet, if such is wanted.
Figure 7:
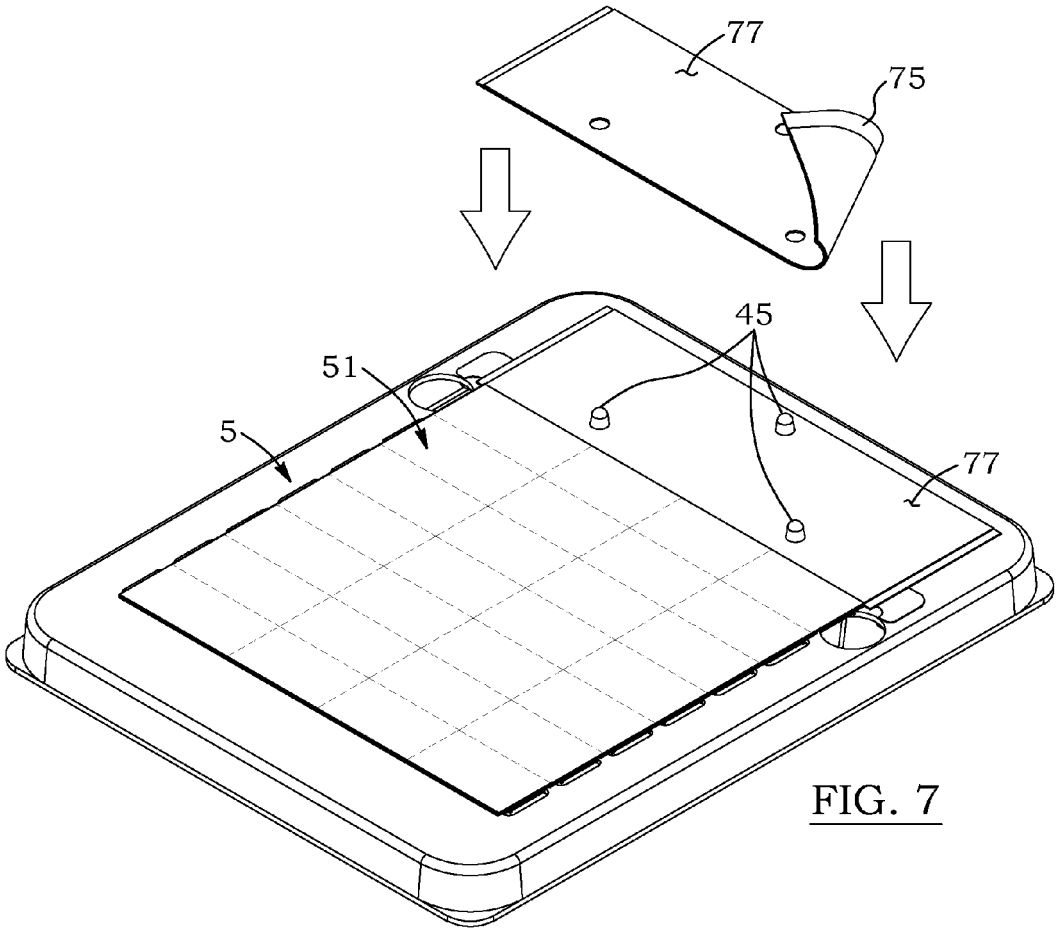
FIG. 7 is a perspective view illustrating how the upper portion of the additional layer can be positioned and glued onto the sealing sheet.
Figure 8:
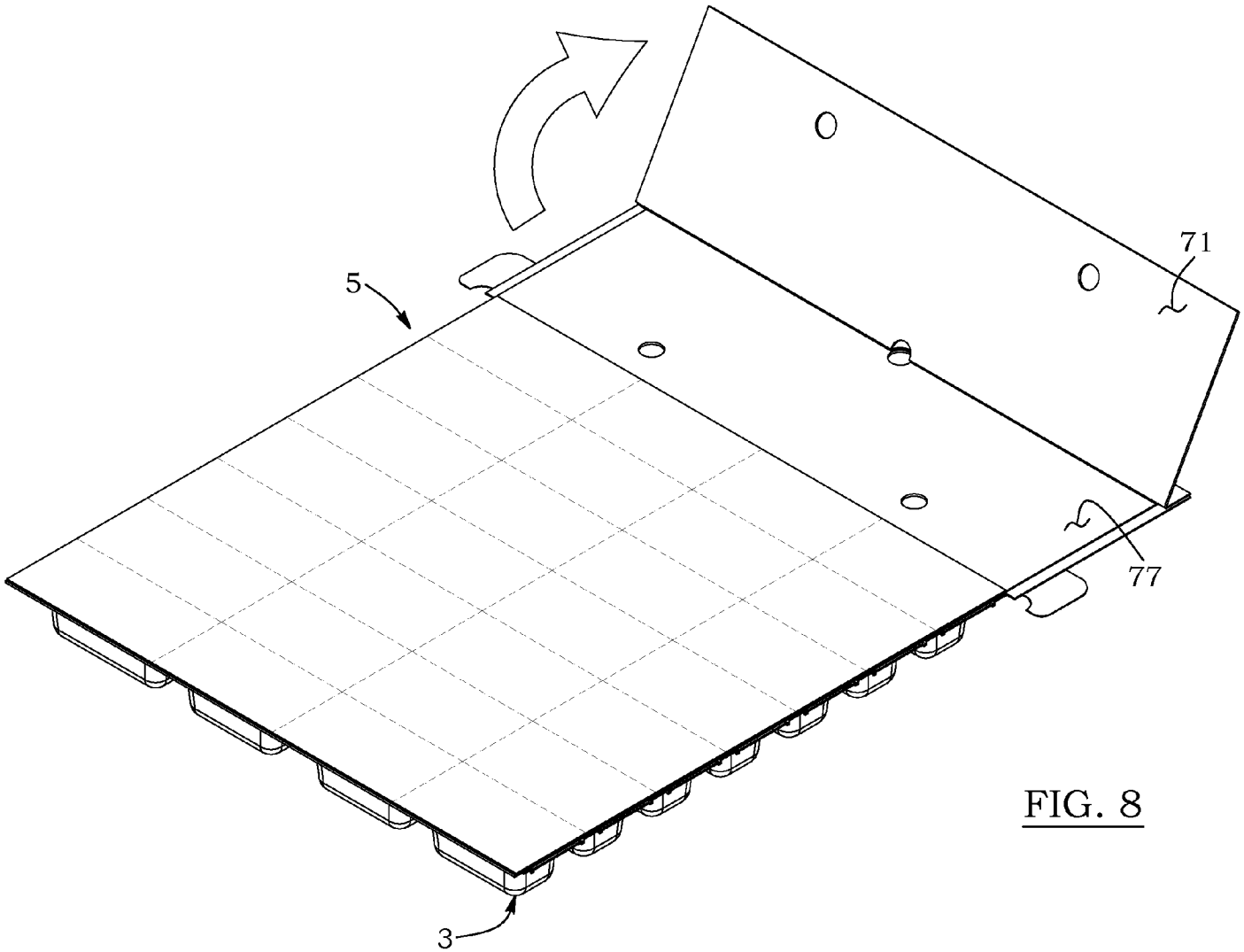
FIG. 8 is a perspective view of the container-defining sheet closed with the sealing sheet with the upper portion of the additional layer glued on it.

As is better shown in FIG. 2, the additional layer 51 preferably has opposite side borders 67 that may be teared off in order to reduce its width and give easier access to the pulling tabs 31 of the bottom pieces 25. The additional layer 51 may also have a bottom border 69 that may be teared off to facilitate access to the peelable bands 61.

In practice and like in the existing kits disclosed in the Canadian and US patents mentioned hereinabove the container-defining sheet 3 intended to be sealed by the improved sealing sheet 51 according to the invention is devised to store individual pills and preferably comprises twenty-eight containers, said containers being positioned to define seven rows and four columns. Of course, the sealing sheet 51 is devised to form a corresponding number of cover pieces that can each be printed with relevant information as to the pills of the corresponding containers and their use.

If necessary and as illustrated in FIG. 9*d*, the additional layer 51 may comprises another additional layer similar to the first one and attached in the same way to it, so as to form additional foldable cover pieces 69 on which further additional information may be printed if needs be.

Of course, it may be understood that, for other applications, the kind of printing and the number of containers may vary.

As also shown in the accompanying drawings, the sealing sheet 5 and the top surface of the container-defining sheet 3 have expansions 75 and 81 advantageously provided with positioning means such as holes 35 that may cooperate with pins 45 extending from the recessed support 1 in order to ensure proper positioning of both of them with respect to each other during installation and exact superimposition of the bottom pieces 25 of the sealing sheet on top of the corresponding cavities 7 and with all the tearing lines of the top layer of the sealing sheet in alignment with the tearing lines of the container-defining sheet 3.

As shown in FIGS. 5 to 8, the additional layer 51 may also have an expansion 71 that is preferably made in such a manner as to be teared off after the installation of the sealing sheet 5 onto the container-defining sheet.

This expansion 71 may advantageously be provided also with a peelable band 73 that gives access to a layer of glue 75 and thus allows this expansion to be glued onto the upper portion 77 of the additional layer 51 and folded up whenever desired. As may be appreciated, such permits to have more space to print information to the upper portion of the kit once assembled.

Of course, numerous modifications could be made to the preferred embodiment of the sealing sheet according to the invention as disclosed hereinabove without departing from the scope of the present invention. In this connection, it is worth reminding that the present invention, even though it is particularly well adapted to the manufacture of sets of individual pill containers for use in the pharmaceutical field, it could be used in other fields for other applications. It may also be noted that the number of containers may vary from one application to another and the shape and size of each of the containers may be modified as requested.

What is claimed is:

1. A sealing sheet for use to close a container-defining sheet having a top surface comprising a plurality of spaced apart cavities embossed therein and positioned in rows and columns, each of said cavities being upwardly opened and thus defining a container that is surrounded by a flange that is part of the top surface of said container-defining sheet, said sealing sheet comprising:

a top layer having an upper surface and a lower surface, said lower surface being covered with a pressure sensitive adhesive glue; and a bottom layer having an upper surface detachably fixed to the lower surface of the top layer by said adhesive glue, said bottom layer being peelable from the lower surface of the top layer to allow fixation of the sealing sheet onto the top surface of the container-defining sheet, in order to close the containers defined in the same, said bottom layer of the sealing sheet having tearing lines punched into it in such a manner and position as to leave parts of said bottom layer glued onto the bottom surface of the top layer in the form of a number of bottom pieces equal to the given number of cavities made in the container-defining sheet when said sealing sheet is peeled off, each of said bottom pieces being shaped, sized and positioned so as to extend over a corresponding cavity of the container-defining sheet when the sealing sheet is properly applied to and glued on the flanges of the top surface of the container-defining sheet, said bottom pieces thus preventing any element stored in the containers from coming into contact with the adhesive glue, said top layer of said sealing sheet also having tearing lines punched therein in such a manner and position as to extend from one side of each of the cover pieces that may be splitted from the sealing sheet, in line with opposite sides of the bottom piece of the corresponding cover piece, in order to facilitate peeling of said bottom piece and of the corresponding part of the cover piece from the corresponding container to have access to the element(s) stored in it, the upper surface of said top layer being devised to allow printing of information on it, which corresponds to what is located in each of the containers, wherein said sealing sheet also comprises:

an additional layer having an upper part and a lower part attached to each other, said upper part having tearing lines punched into it in such a manner and position as to match with the tearing lines of the top layer of the sealing sheet and thus form an additional element on the upper surface of the top layer on each of said container, said lower part having peelable bands that can be removed to allow gluing of each of said additional elements onto the upper surface of the top layer of each container on one side of it so as to allow said additional element to be folded up, said lower part also having tearing lines positioned to match those of the top part of the additional layer but except on the peelable bands, whereby, in use, additional information may be printed onto one or both sides of said additional layer to add information to what is located in each of the containers, such added information as well as the information already printed on the upper surface of the top layer being easily accessible by merely folding up the additional element of each of the container.

2. The sealing sheet according to claim 1, wherein:

the container-defining sheet comprises recesses embossed therein so as to extend adjacent to the one side of each of the cover pieces from which extend the tearing lines allowing peeling of the corresponding bottom piece from the corresponding container, said recesses being U-shaped so as to give easy access to a finger and thus facilitate such a peeling;

the tearing lines of the bottom layer of said sealing sheet are devised so as to provide each of the bottom pieces with a small pulling tab projecting from one edge of bottom piece, said pulling tab being opposite to the side where is glued the foldable additional element and being positioned in such a manner that once the sealing sheet is glued on top of the container defining-sheet, said pulling tab extends at a short a distance away from the cavity of the corresponding container towards the adjacent recess embossed therein, such facilitating again peeling of said bottom piece from said container; and the top layer has additional tearing lines punched therein in such a manner as to extend toward the pulling tab along the edge of the bottom piece from where said pulling tab projects, said additional tearing lines extending transversally from the tearing line that are in lines with the opposite side of the bottom piece along the edge of it, up to the pulling tab.

3. The sealing sheet according to claim 2, wherein:

each of the flanges that are parts of the top surface of the container-defining sheet and are not directly adjacent to one side of said container-defining sheet, are provided with a centrally positioned tearing line so as to make it possible to separate each of the containers from the adjacent containers and thus from the container-defining sheet whenever desired;

the top layer of the sealing sheet also have other tearing lines punched therein in such a manner and position as to be in line with the tearing lines of the container-defining sheet and thus to allow said top layer, once glued onto the flanges of the container-defining sheet, to be splitted into a number of cover pieces equal to the number of containers, such making it possible to detach each of said containers from the container defining sheet while keeping it closed.

4. The sealing sheet according to claim 3, wherein the sealing sheet and the top surface of the container-defining sheet are provided with positioning means to ensure proper positioning of both of them with respect to each other during installation and thus exact superimposition of the bottom pieces of the sealing sheet on top of the corresponding cavities, and exact superimposition of the tearing lines of the top layer of the sealing sheet with the tearing lines of container-defining sheet.

5. The sealing sheet according to claim 4, wherein said positioning means consists of at least two spaced apart holes sized to fit onto pins projecting from a support.

6. The sealing sheet according to claim 5, wherein:

said sealing sheet is made of paper; and said container defining sheet is made of plastic material.

7. The sealing sheet according to claim 6, wherein:

the container-defining sheet is intended to store individual pills and comprises twenty-eight containers, said containers being positioned to define seven rows and four columns; and the sealing sheet is devised to form a corresponding number of cover pieces that are each printed with relevant information as to the pills of the corresponding containers and their use.

8. The sealing sheet according to claim 2, wherein the additional layer has opposite side borders that may be teared off in order to reduce the width of said additional layer and give easier access to the pulling tabs of the bottom pieces.

9. The sealing sheet according to claim 5, wherein the additional layer has opposite side borders that may be teared off in order to reduce the width of said additional layer and give easier access to the pulling tabs of the bottom pieces.

10. The sealing sheet according to claim 7, wherein the additional layer has opposite side borders that may be teared off in order to reduce the width of said additional layer and give easier access to the pulling tabs of the bottom pieces.

11. The sealing sheet according to claim 1, wherein the additional layer has an expansion which is devised to facilitate its positioning onto the top layer of the sealing sheet and which may be thereafter teared off and glued in a foldable way onto another extension of said top layer to give more space to printed information.

12. The sealing sheet according to claim 9, wherein the additional layer has an expansion which is devised to facilitate its positioning onto the top layer of the sealing sheet and which may be thereafter teared off and glued in a foldable way onto another extension of said top layer to give more space to printed information.

13. The sealing sheet according to claim 10, wherein the additional layer has an expansion which is devised to facilitate its positioning onto the top layer of the sealing sheet and which may be thereafter teared off and glued in a foldable way onto another extension of said top layer to give more space to printed information.

* * * * *